US005860300A

United States Patent [19]

Valent

[11] Patent Number: 5,860,300

[45] Date of Patent: Jan. 19, 1999

[54] CLOTHES WASHING MACHINE OR A SIMILAR APPLIANCE HAVING IMPROVED LOADING DUCT

[75] Inventor: Lucio Valent, Pordenone, Italy

[73] Assignee: Electrolux Zanussi Elettrodomestici S.p.A., Pordenone, Italy

[21] Appl. No.: 929,723

[22] Filed: Sep. 15, 1997

[30] Foreign Application Priority Data

Sep. 24, 1996 [IT] Italy ..... PN96A0053

[51] Int. Cl.[6] ..... D06F 37/10

[52] U.S. Cl. ..... 68/24; 68/58; 68/142; 68/210

[58] Field of Search ..... 134/159; 68/24, 68/58, 140, 142, 139, 20, 19.2, 210

[56] References Cited

U.S. PATENT DOCUMENTS

| | | | |
|---|---|---|---|
| 2,296,257 | 9/1942 | Breckenridge | 68/24 |
| 2,552,855 | 5/1951 | Johnston | 68/140 |
| 2,807,963 | 10/1957 | Osterhus et al. | 68/24 |
| 2,910,854 | 11/1959 | Hughes | 68/19.2 |
| 2,968,174 | 1/1961 | Bell et al. | 68/24 |
| 2,975,626 | 3/1961 | Frey | 68/24 |
| 3,276,229 | 10/1966 | Deiss | 68/24 |
| 3,740,975 | 6/1973 | Cornelius | 68/24 |
| 4,794,661 | 1/1989 | Durazzani | 68/58 |

FOREIGN PATENT DOCUMENTS

| | | |
|---|---|---|
| 657574 | 6/1995 | European Pat. Off. . |
| 2296018 | 6/1996 | United Kingdom . |

*Primary Examiner*—Frankie L. Stinson
*Attorney, Agent, or Firm*—Pearne, Gordon, McCoy & Granger LLP

[57] ABSTRACT

A clothes washing machine, or a similar appliance such as a washer/dryer, includes a flexible duct, such as a bellows, arranged between the opening (5) of a door (4), intended for loading and unloading the clothes, and an associated opening (8) provided on an inner washing tub (10). Peripheral folds (16), the outer end (13) and a cylindrical band (15) of the bellows (12), are made with a material having elastomeric properties and a hardness of about Shore A 20 to 30. The inner end (15) of the bellows is made with a synthetic material having a hardness of about Shore A 40 to 50. The machine is low noise. A greater unbalanced load of clothes can be tolerated since the improved bellows minimize the vibrations, generated by the inner washing tub when the machine is operated, which are transmitted to the outer cabinet of the machine. The bellows have a low manufacturing cost and are interchangeable with those of conventional construction, namely those entirely made with a material of the same hardness (Shore A 33–35 or above).

7 Claims, 4 Drawing Sheets

CLOTHES WASHING MACHINE OR A SIMILAR APPLIANCE HAVING IMPROVED LOADING DUCT

BACKGROUND OF THE INVENTION

The present invention relates to a clothes washing machine, or a similar appliance such as a washer/dryer, particularly intended for a household utilization, of the type having a perforated drum rotatable around a horizontal axis.

As is well known, a machine of this type includes an outer cabinet provided with an opening for a front or an upper loading door to load and unload the clothes to be washed. An inner tub contains the washing solution and the aforesaid drum. An elastic duct, usually known as the bellows, is positioned between the opening provided in the outer cabinet for the loading door and an associated opening provided in the inner tub.

A current construction of bellows that are presently utilized on washing machines having a front mounted loading door is disclosed in the British patent application no. 2 296 018. It is also generally known, on the machines with a top mounted loading door, to have a plurality of peripheral circumvolutions along a substantial portion of the bellows length in order to let the inner tub oscillate with respect to the outer cabinet when the machine is operated. The bellows also include, integrally made with the said circumvolutions, a first and a second flanged end. The former end is secured to the opening provided in the outer cabinet for the loading door and the latter end is secured to the opening provided in the inner tub.

Being entirely made as a single piece, the known bellows need to be made with a material, which is a mixture having elastomeric properties, able to meet various or even opposing requirements. In particular, such a material has to meet the severe requirements imposed by the latter mentioned end of the bellows. The end of the bellows secured to the loading opening in the inner tub must resist to the repeated abrasions, caused by contact with clothes kept in movement within the rotary drum, and to the corrosion due to the washing solution. At the same time, the bellows must have a good dimensional stability to guarantee a seal against water leakages. As a consequence, it is a common practice for the manufacturers of washing machines to make the entire bellows as a single piece with elastomeric mixtures of a hardness above Shore A 33–35, so as to satisfy all of the above mentioned requirements.

In the bellows of such a construction, a common drawback is that substantially all vibrations, which are generated inside the inner tub when the machine is operated, are transmitted to the outer cabinet. More precisely, the following negative effects are noticed:

- a high airborne noise is emitted by the machine;
- the vibrations (oscillations and accelerations) can spread through the structure of the house and to the furniture surrounding the washing machine, particularly in case of a wooden or another not very rigid floor;
- a low limit of the unbalanced load of clothes has to be accepted by a manufacturer of a washing machine. This means, especially in case of machines controlled by a "fuzzy" logic, a high probability to repeat the attempts of spinning in order to obtain the required distribution of the clothes to be washed inside the rotary drum.

BRIEF SUMMARY OF THE INVENTION

A main purpose of the present invention is to eliminate the aforesaid negative effects using bellows which are of a simple, reliable and low cost construction, and can also be easily installed by the after sales service engineers.

All these results, and others mentioned below, are reached by a washing machine having the elongated portion of the bellows formed with folds made of an elastomeric material having a hardness of about Shore A 20 to 30.

BRIEF DESCRIPTION OF THE SEVERAL VIEWS OF THE DRAWING

For a better understanding, a preferred, though not limiting, embodiment of the invention will now be described with the help of the attached drawings wherein.

DESCRIPTION OF THE INVENTION

Figure 1:
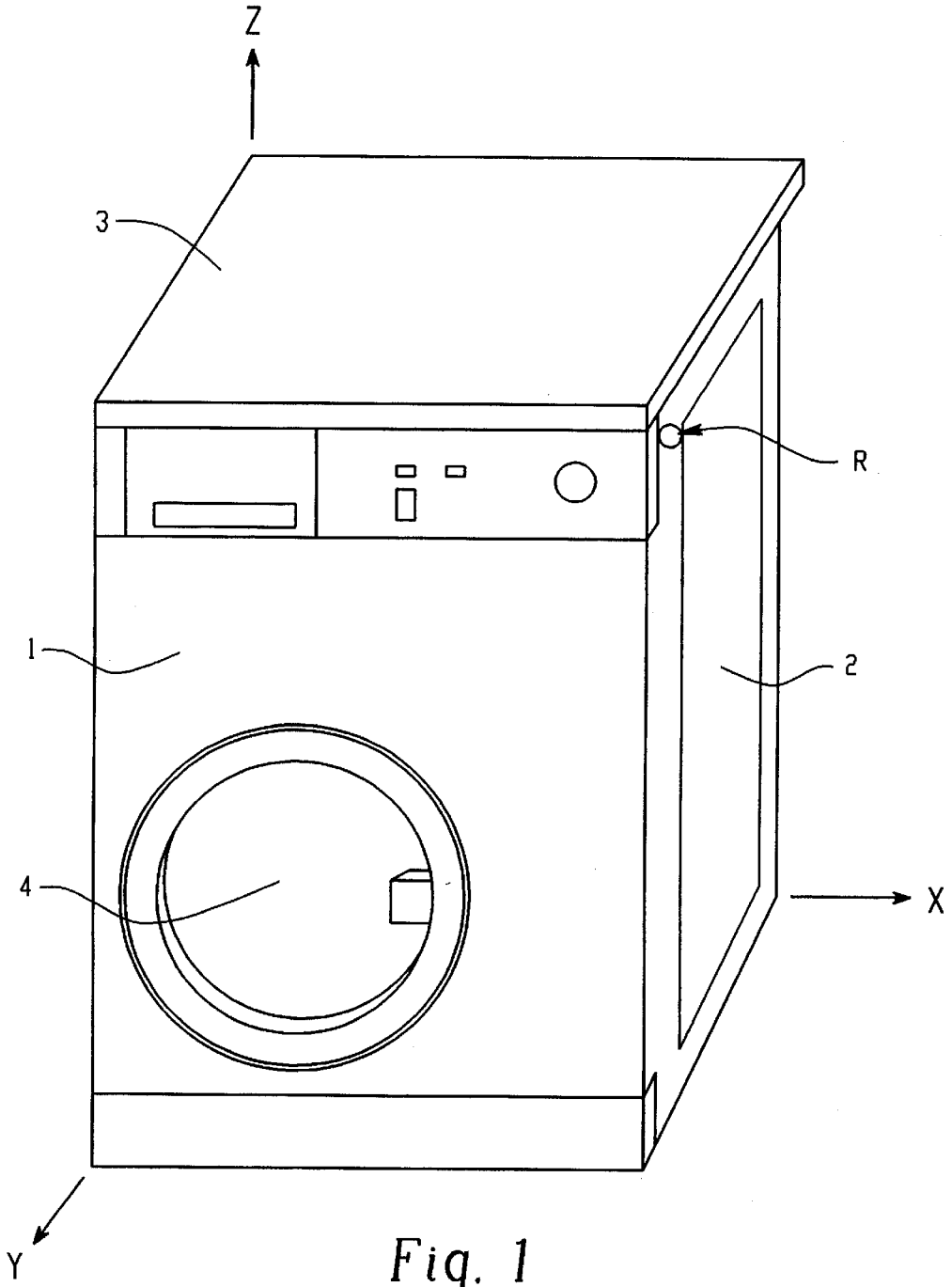
FIG. 1 is a schematic perspective view of a clothes washing machine or a washer dryer, of the type provided with a front loading door, the three Cartesian axis which are referred to in the measurement of the vibrations is also represented.
Figure 2:
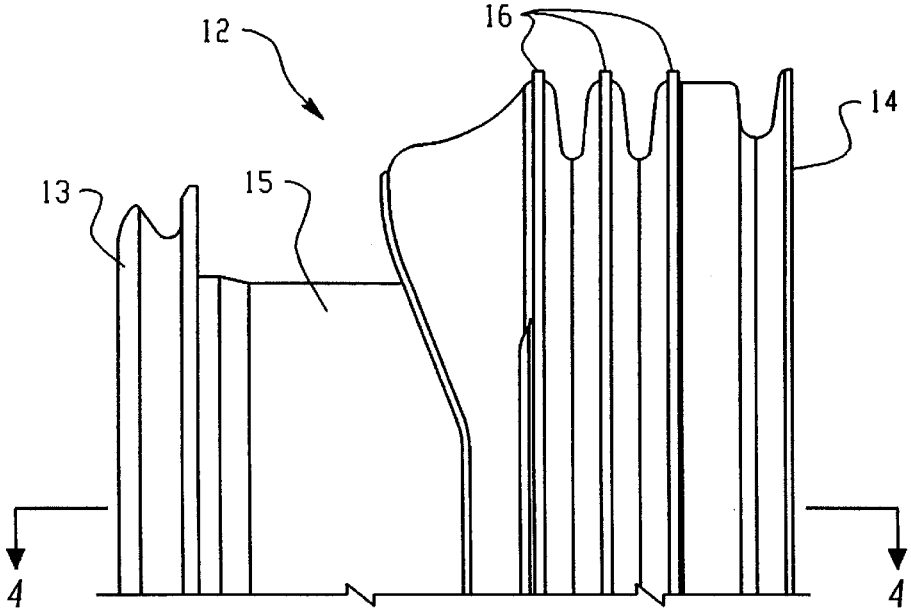
FIG. 2 is a side view of the top of the elastic duct (bellows) of the invention, intended for a clothes washing machine of the type shown in FIG. 1.
Figure 3:
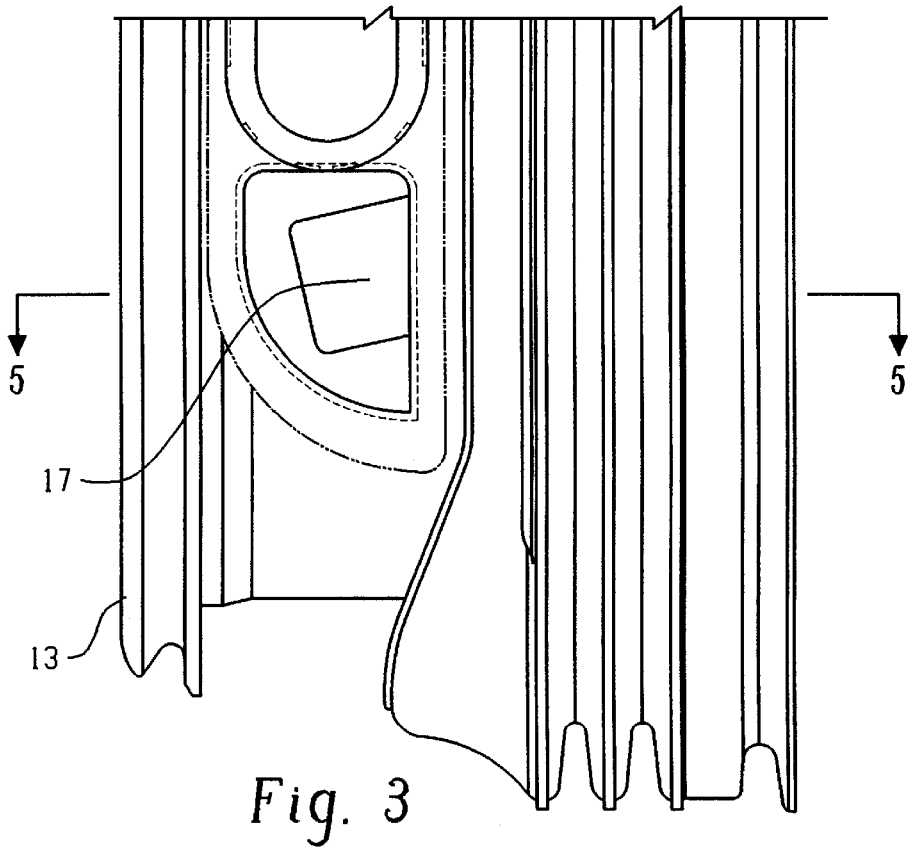
FIG. 3 is a side view of the bottom of the elastic duct (bellows) of the invention, intended for a clothes washer dryer of the type shown in FIG. 1.
Figure 4:
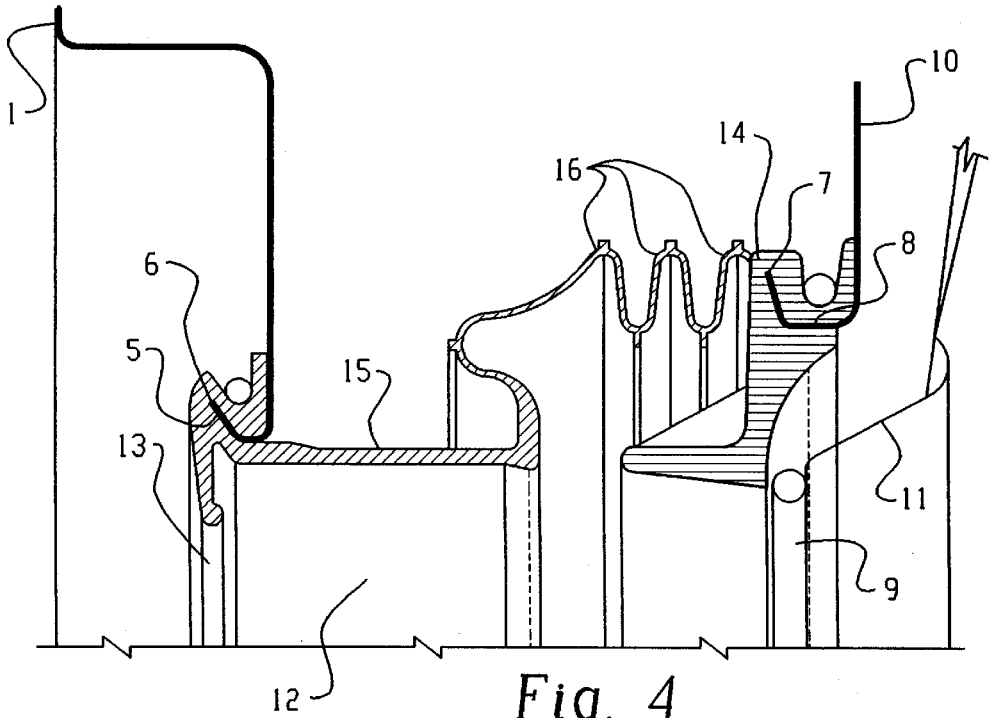
FIG. 4 shows a vertical cross section (along the line IV—IV of FIG. 2), limited to the portion between the front surface of the outer cabinet and the inner tub, of a clothes washing machine equipped with the bellows of the invention.

Referring to FIG. 1, a manner well known in the art, a clothes washing machine or a washer dryer consists essentially of a parallelepiped outer cabinet having a front surface 1, two sidewalls 2 and a worktop 3. In case of a front loading machine, as in the presently described embodiment, the door for loading and unloading the clothes is in the form of a so-called port-hole 4, pivoted onto the front surface 1 at an opening 5 (FIGS. 4 and 5) provided therein. As shown in FIGS. 3 and 4, a so-called washing unit is set inside the outer cabinet. The parts directly related to the present invention are a tub 10 for the washing liquid and the clothes that contains a perforated drum 11, rotatable around a horizontal axis. A flexible duct or bellows designated by the general reference 12 is positioned between the opening 5 in the outer cabinet for the port-hole 4 and the inner tub 10.

Figure 5:
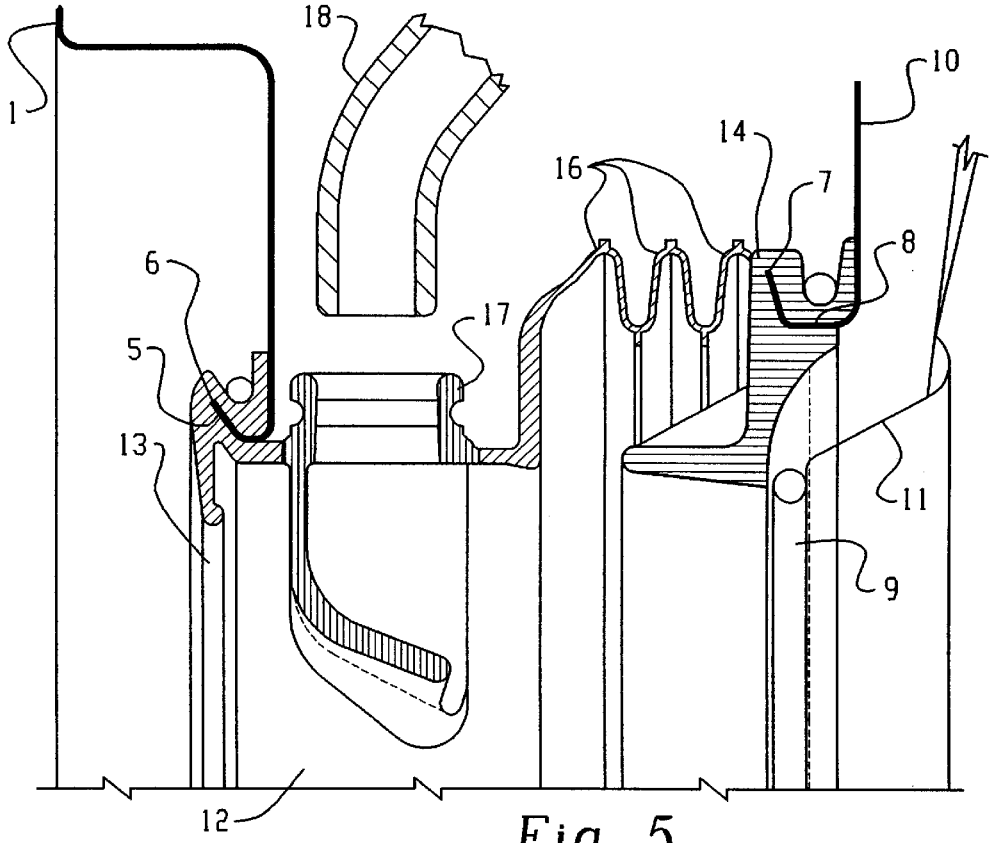
FIG. 5 shows a vertical cross section (along the line V—V of FIG. 3), limited to the portion between the front surface of the outer cabinet and the inner tub, of a clothes washer dryer equipped with the bellows of the invention.

As shown in FIGS. 2 to 5, the bellows 12 include an outer circular end 13, which is fitted, by known means, onto the edge 6 of the opening 5 provided in the outer cabinet and an inner circular end 14, which is fitted onto the edge 7 of the associated opening 8 of the washing tub 10, quite close to the opening 9 of the drum 11, as best seen in FIGS. 4 and 5. The bellows 12 act as a tunnel for loading and unloading the clothes into and out of the tub 10 and, furthermore, as a gasket to prevent the washing solution to leak therefrom. The bellows 12 includes a cylindrical band 15 with a plurality of circumferential folds 16 extending along a substantial portion of the bellows length. In case of a washer/dryer (as shown in FIG. 5), the bellows 12 includes, at the cylindrical band, an opening 17 for a duct 18 intended for supplying warm air to be used for drying the clothes loaded in the inner tub 10.

In accordance with a preferred embodiment of the invention, the bellows 12 are not entirely made as a single piece of a relatively hard material, as has been known up to now, but made of various parts having a different hardness. More precisely the folds 16 and, preferably, also the outer circular end 13 and the cylindrical band 15, of the bellows 12 are made with a material having elastomeric properties and a relatively low hardness. A particularly suitable material is a mixture of EPDM (ethylene-propilene terpolymer) having a hardness of about Shore A 20–30. In other words, due to low elastic modulus, the above mentioned parts of the bellows are particularly efficient in dampening the vibrations transmitted from the inner washing unit to the outer cabinet of the washing machine, as it is described below.

The inner circular end 14 of the bellows is made with a synthetic material (either elastomeric or plastomeric) of a hardness of about Shore A 40–50, the hardness is higher than the folds 16 of the bellows 12, thus it has a high resistance to wear (rubbing action by the clothes) and to corrosion (alkaline titration of the washing solution). A particularly suitable material for making the inner end 14 of the bellows 12 is, for example, an EPDM (ethylene-propilene terpolymer)-based mixture filled with 30% silicon-dioxide.

The opening 17 for the warm air duct 18 is an insert, provided at the cylindrical band 15, preferably made with a synthetic material resistant to temperatures up to about 160–170 degrees Celsius (320–338 degrees Fahrenheit) and of a significant hardness (about Shore A 40–50). An EPDM (ethylene-propilene terpolymer) based mixture, cured in the presence of peroxides and a silicone-based synthetic material are examples of suitable materials.

The techniques applicable for the manufacture of bellows 12 according to the invention are known and used, for example, in the manufacturing processes of sport footwears, which consist of various parts made with mixtures of a different color shade. It is also possible to produce the parts separately, by injection and/or pressure molding, with a different hardness and subsequently bond the parts to one another. For example a conventional glueing or high-frequency welding techniques or a curing process can be used.

In order to test the aforesaid ability of the bellows 12 to dampen the vibrations transmitted from the inner washing unit to the outer cabinet, the Applicant has used a clothes washing machine of the type generally shown in FIG. 1, a presently produced construction having a spinning speed selectable by users in the range 450 to 1200 rounds/minute (RPM).

The following vibrations were measured during the tests:

a. the displacement vibrations of the outer cabinet of the washing machine. A laser pickup, aimed at the front right corner of the cabinet (as shown by the black spot R in FIG. 1) was used to record the cabinet oscillations parallel to axis X of FIG. 1, and b. the acceleration vibrations of the machine, as supported by four feet resting on an appropriate resilient floor. An accelerometer having a sensor positioned below one of the feet was used to record the accelerations parallel to axis Z of FIG. 1.

At first the washing machine was equipped with conventional bellows, specifically a bellows integrally made as a single piece of an EPDM-based mixture having a hardness of Shore A 40. The recorded data for,a number of spinning speeds are plotted in the graphs A and C of the FIGS. 6 respectively 7 and, for convenience, reported in the following Tables I and II. The data given here are not absolute values (measured in mm and $m/s^2$ respectively) but are values relative to respective reference values of 100 at the lowest spinning speed.

The same washing machine was subsequently equipped with bellows made according to the present invention, namely with the same construction as tested for graphs A and C but having:

the outer circular end 13, the cylindrical band 15 and the circumferential folds 16 made with an EPDM-based mixture with a hardness of Shore A 27; and the inner end 14 made with an EPDM-based mixture with a hardness of 40 Shore A.

Figure 6:
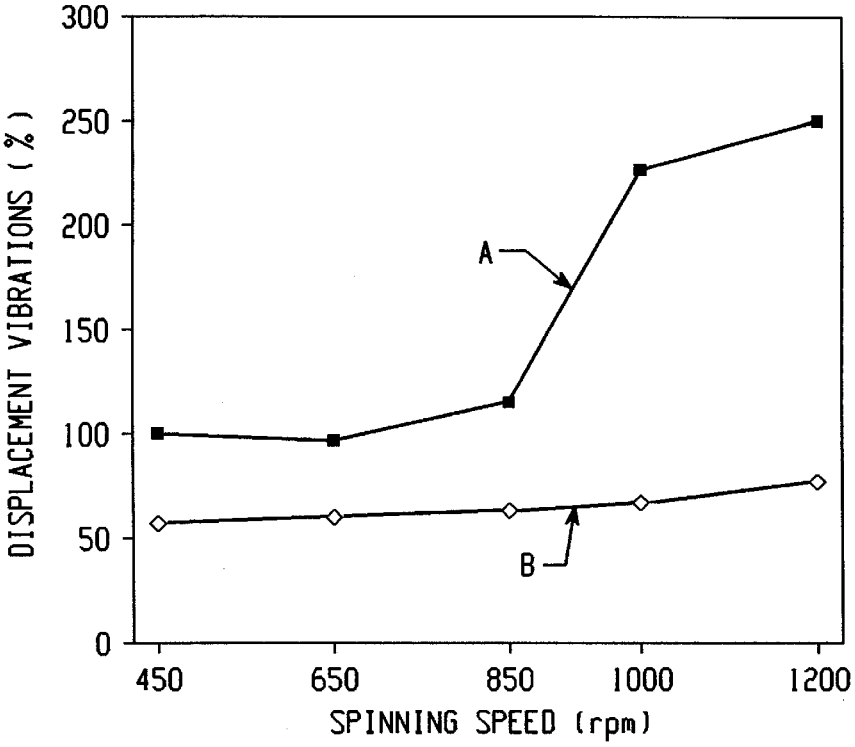
FIG. 6 shows diagrams of the amplitudes of displacement vibrations of a washing machine cabinet at various spinning speeds in case of a reference clothes washing machine equipped with conventionally made bellows (graph A), and with the bellows of the invention (graph B)
Figure 7:
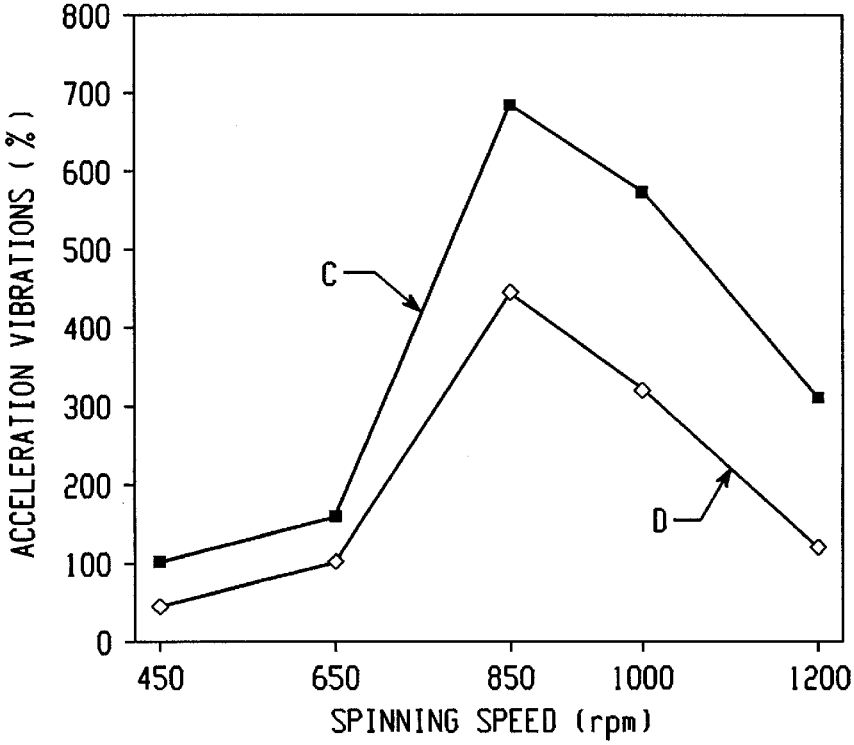
FIG. 7 shows diagrams of the amplitudes of acceleration vibrations of a washing machine cabinet at various spinning speeds in case of a reference clothes washing machine equipped with conventionally made bellows (graph C), with the bellows of the invention (graph D).

The recorded data of the second set of tests, measured at the same spinning speeds, are plotted in the graphs B and D of FIG. 6 respectively 7 and, for convenience reported in the subsequent Tables I and II. Of course, also in this case the data given here are not absolute values (measured in mm and in $m/s^2$, respectively) but are values relative to the respective reference values of 100 at the lowest spinning speed. This permits a direct comparison with the graphs A and C In order to make even easier such a comparison, in the subsequent Tables I and II also the values of the ratios B/A, respectively C/D, are given since they are an indirect index of the bellows efficiency in respect of the noise of the machine.

TABLE I

| | displacement vibrations | | | | |
|---|---|---|---|---|---|
| | 450 RPM | 650 RPM | 850 RPM | 1000 RPM | 1200 RPM |
| A (prior or 2) | 100 | 97 | 112 | 224 | 248 |
| B (invention) | 54 | 59 | 62 | 66 | 76 |
| B/A × 100 | 54 | 61 | 55 | 29 | 30 |

TABLE II

| | acceleration vibrations | | | | |
|---|---|---|---|---|---|
| | 450 RPM | 650 RPM | 850 RPM | 1000 RPM | 1200 RPM |
| C (prior or 1) | 100 | 159 | 679 | 569 | 313 |
| D (invention) | 51 | 101 | 443 | 317 | 122 |
| D/C × 100 | 51 | 63 | 65 | 55 | 39 |

As shown the improvement provided by the invention is particularly significant at the values of spinning speeds that are more commonly selected by the more environment concerned users, namely 1000 RPM or higher.

To conclude, the advantages of the invention can be summarized as follows:

the airborne noise emitted by the clothes washing machine is reduced;

the vibrations of the machine transmitted through the floor are reduced. This is important when the machine is installed in a living room and/or in the upper floor of a house having a lightweight structure, for instance a wooden beam floor;

the unbalance compensating devices of the machine can be reduced, or even eliminated, particularly in the most recent models controlled by a Fuzzy logic;

due to the fact that their configuration remains unchanged, conventionally made bellows of an already installed machine can be easily replaced by an engineer of the aftersales service with bellows made according to the invention.

According to another embodiment of the present invention, the entire bellows can be made in a single piece with a material of elastomeric properties having a quite low hardness (about Shore A 20 to 30) especially, although not exclusively, when the washing machine or washer dryer is of the type provided with an upper loading door. The ends of the bellows will then be square rather than circular, as it is well known to those skilled in the art.

It is intended that other variants of the invention to be developed by the technicians skilled in the art will be covered by this patent. In particular, this patent covers also a variant wherein the inner end 14 of the bellows 12 is made with a thermoplastic or thermosetting synthetic material that can be even fully rigid and the peripheral folds 16 are made with a thermoplastic or thermosetting synthetic material with a hardness of about Shore A 20 to 30.

What is claimed:

1. A clothes washing machine, comprising an outer cabinet; an opening (5) in the cabinet for loading and unloading the clothes; a door (4) for closing the opening; an inner stationary tub (10) in the cabinet; a drum (11) rotatable around a horizontal axis supported inside said tub (10); an opening (8) in the inner tub associated with the opening (5) for the door; and a flexible duct (12) positioned between the opening (5) for the door (4) and the associated opening (8) provided in the inner tub (10) and having an elongated portion formed with a plurality of folds (16), characterized in that the duct (12) comprises an outer end (13) engageable onto an edge (6) of said opening (5) of the cabinet for the loading door (4); an elongated band (15) extending inwardly from the outer end (13); and the plurality of peripheral folds (16) extending inwardly from the elongated band; the outer end, elongated band, and peripheral folds (13,15,16) being made with a material with elastomeric properties and a hardness of about Shore A 20 to 30, and the duct (12) further comprises an inner end (14), engageable onto an edge (7) of said opening (8) provided in the tub (10), the inner end (14) being made with a synthetic material with a hardness exceeding the hardness of the outer end, elongated band, and peripheral folds (13,15,16).

2. A clothes washing machine according to claim 1, characterized in that the inner end (14) has a hardness of about Shore A 40 to 50.

3. A clothes washing machine according to claim 1, characterized in that all the parts (13,14,15,16) of the duct (12), are based on polymers which are compatible with one another.

4. A clothes washing machine according to any of claim 1 or 3, characterized in that the inner end (14) of the duct (12) is made with a thermoplastic or thermosetting synthetic material, and the peripheral folds (16) are made with a synthetic material.

5. A clothes washing machine according to any claims 1 to 3, characterized in that all the parts (13,14,15,16) of the bellows (12) are produced in a single injection molding process by means of an appropriate number of injection heads.

6. A clothes washing machine according to any of claims 1 to 3, characterized in that the parts (13,14,15,16) of the bellows (12) having a different hardness are molded separately and subsequently fixedly bonded to one another.

7. A clothes washing machine according to claim 1, comprising a closed circuit of warm air to dry the clothes after a washing phase, characterized in that an insert opening (17) is incorporated in the elongated band (15) of the duct (12) for receiving an input duct (18) for supplying into the stationary tub (10) the warm drying air, the insert opening (17) being made with a synthetic material resistant to a temperature of at least 150 degrees Celsius and with a hardness of about Shore A 35 to 50.

* * * * *